US005714723A

United States Patent [19]

Kang

[11] Patent Number: 5,714,723

[45] Date of Patent: Feb. 3, 1998

[54] SPEAKER ASSEMBLY HAVING A COUPLING MECHANISM

[76] Inventor: Shih-Chang Kang, No. 125-1, Section 1, San Min Road, Taichung, Taiwan

[21] Appl. No.: 713,450

[22] Filed: Sep. 13, 1996

[51] Int. Cl.[6] ..... A47B 81/06

[52] U.S. Cl. ..... 181/199

[58] Field of Search ..... 181/144, 145, 181/148, 199; 381/90, 205

[56] References Cited

U.S. PATENT DOCUMENTS

| | | | |
|---|---|---|---|
| 4,014,597 | 3/1977 | Griffin, Jr. | 181/199 |
| 4,130,174 | 12/1978 | Ostrander et al. | 181/199 X |
| 4,805,730 | 2/1989 | O'Neill et al. | 181/148 |
| 4,884,655 | 12/1989 | Freadman et al. | 181/145 |
| 5,000,286 | 3/1991 | Crawford et al. | 181/145 |
| 5,416,284 | 5/1995 | Steele et al. | 181/199 |

*Primary Examiner*—Khanh Dang
*Attorney, Agent, or Firm*—Charles E. Baxley, Esq.

[57] ABSTRACT

A speaker assembly includes two housing and two couplers secured in the housings. One of the couplers includes a bore and the other coupler includes an extension for engaging with the bore so as to secure the couplers and the housing together. One of the couplers includes a curved slot and the other coupler includes a projection for engaging with the curved slot so as to limit the rotational movement between the couplers. The couplers each includes a bore for engaging with a wire or a connecting line. A number of housings may be secured together so as to form a speaker wall.

6 Claims, 9 Drawing Sheets

SPEAKER ASSEMBLY HAVING A COUPLING MECHANISM

BACKGROUND OF THE INVENTION

1. Field of the Invention

The present invention relates to a speaker, and more particularly to a speaker assembly having a coupling mechanism for coupling the speakers together.

2. Description of the Prior Art

Typical speakers comprise a housing having an enclosed configuration that may not be easily secured and assembled with the other speaker housings. Normally, the speaker housings comprise a number of holes or screw holes for engaging with bolts so as to secure the speaker housings together. However, it will be difficult to disassemble the speaker housings for securing the bolts.

The present invention has arisen to mitigate and/or obviate the afore-described disadvantages of the conventional speakers.

SUMMARY OF THE INVENTION

The primary objective of the present invention is to provide a speaker assembly which includes a coupling mechanism for allowing the speakers to be easily secured together with each other.

In accordance with one aspect of the invention, there is provided a speaker assembly comprising at least one first housing and at least one second housing, at least one first coupler secured to the first housing and including a bore formed therein and at least one second coupler secured to the second housing and including an extension extended therefrom for engaging with the bore of the first coupler so as to secure the second coupler to the first coupler and so as to secure the second housing to the first housing.

The first coupler includes at least one curved slot formed therein, the second coupler includes at least one projection formed thereon for slidably engaging with the curved slot so as to limit a rotational movement between the first and the second couplers.

The first and the second housing each includes a pair of notches of different size so as to form a shoulder therebetween, the first and the second couplers each includes a middle portion having a peripheral groove formed therein so as to define two plates for engaging with the notches.

The middle portions of the first and the second couplers each includes board having a square cross section for engaging with the notches.

The bore of the first coupler includes a first end having an orifice of larger diameter formed therein for engaging with the extension of the second coupler.

The second coupler includes a bore formed therein for engaging with a wire therein.

A bolt is engaged through the bores of the first and the second couplers, and two nuts are engaged with the bolt so as to secure the first and the second couplers together.

The extension of the second coupler includes at least one slit formed therein so as to define at least two resilient blade, and includes a free end portion having a hook formed thereon for engaging with the first coupler so as to secure the second coupler to the first coupler.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
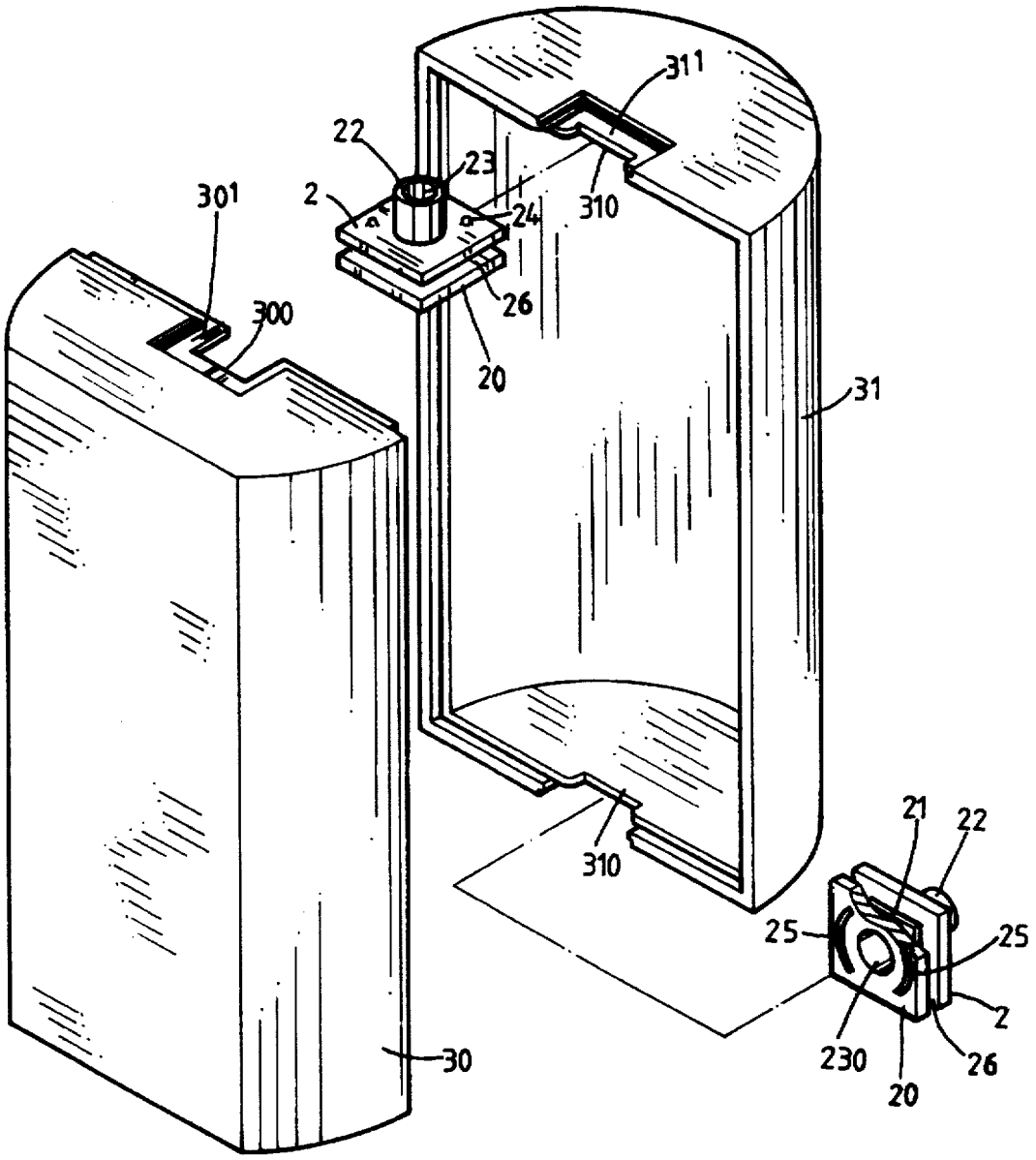
FIG. 1 is an exploded view of a speaker in accordance with the present invention.
Figure 2:
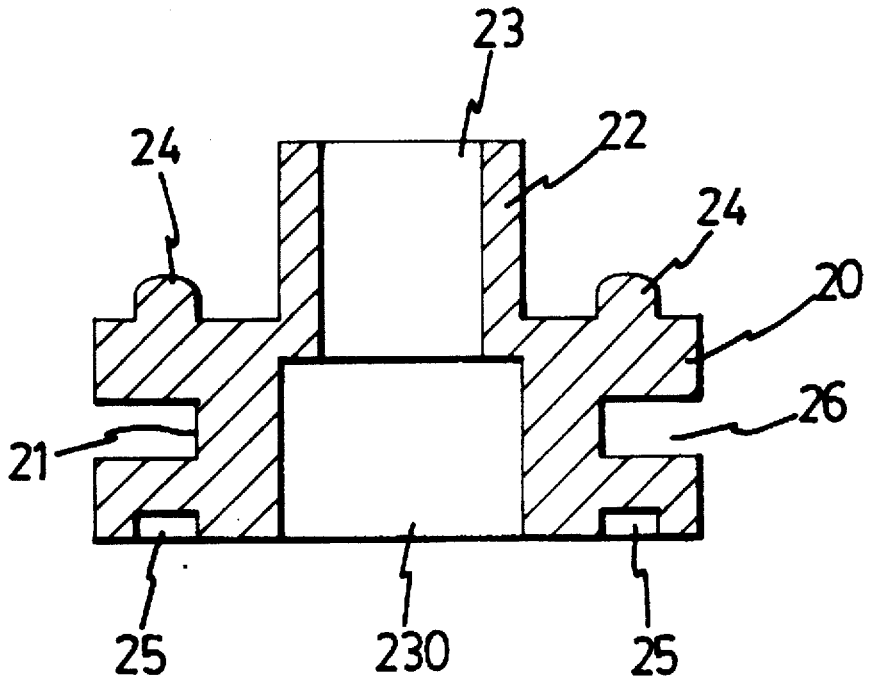
FIG. 2 is a cross sectional view of a coupler.
Figure 3:
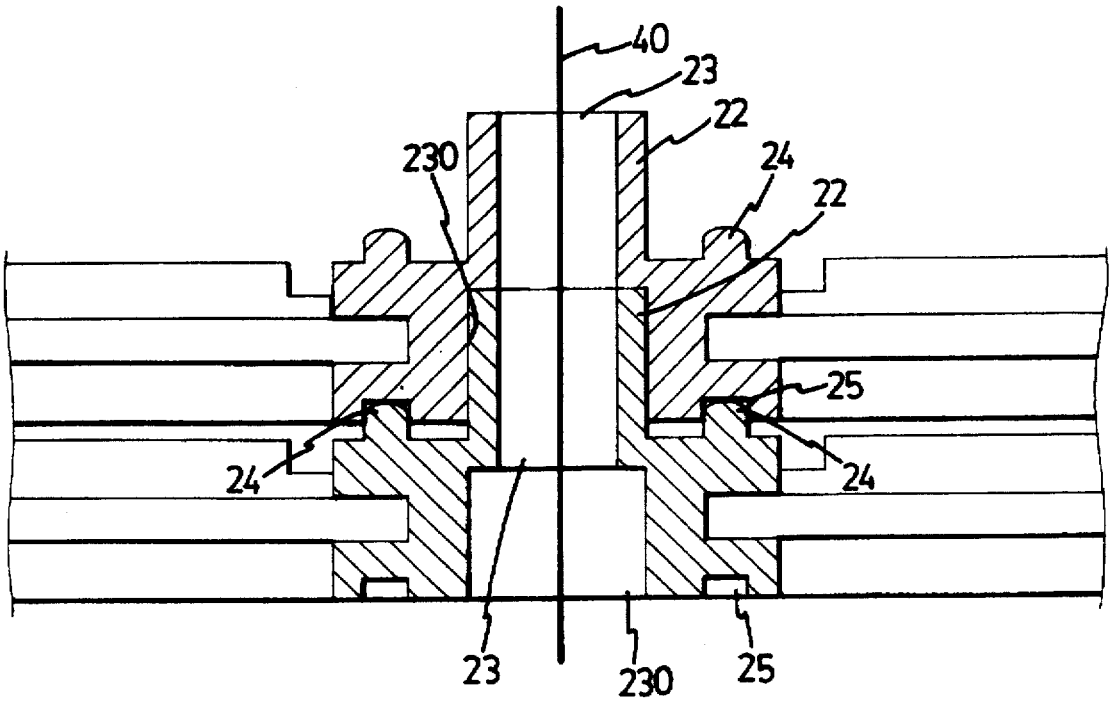
FIG. 3 is a cross sectional view illustrating the engagement of two couplers.

Referring to FIGS. 1 to 3, a speaker assembly in accordance with the present invention comprises two or more couplers 2 for coupling two or more speaker housings together. The speaker housing includes two housing members 30, 31 secured together so as to form the speaker housing. The housing members 30, 31 each includes at least one pair of notches 300, 301, 310, 311 formed in the peripheral portion. The notches 301, 311 have a size larger than that of the other notches 300, 310 so as to form a shoulder therebetween.

Figure 4:
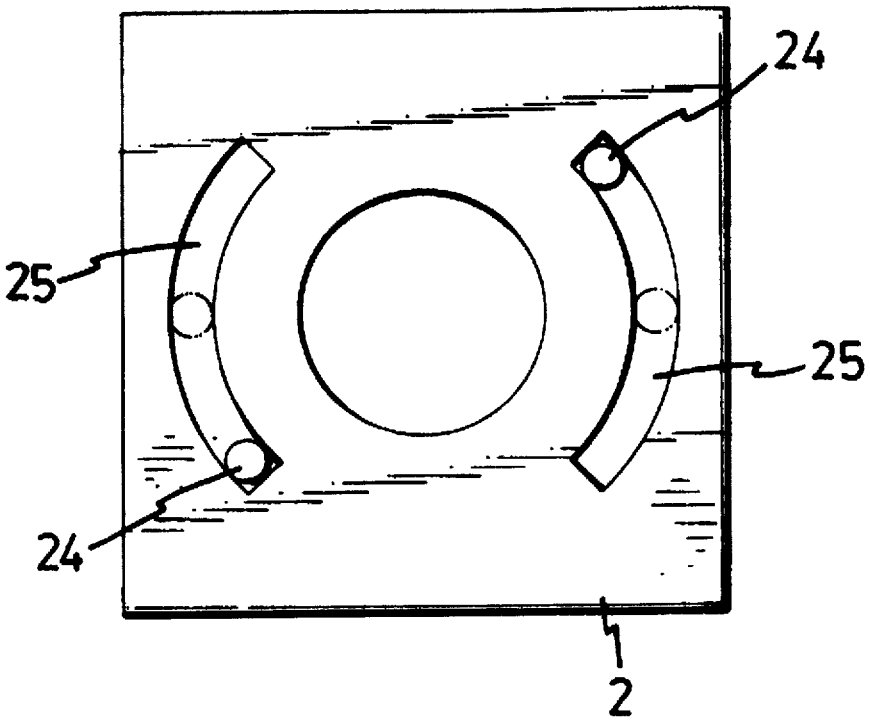
FIG. 4 is a schematic view illustrating a projection and slot engagement between the couplers.

The couplers 2 each includes a peripheral groove 26 formed in the middle portion thereof so as to define a pair of plates 20 for engaging with the notches 301, 311. The peripheral groove 26 may be engaged with the notches 300, 310. It is preferable that the couplers 2 each includes a board 21 of square cross section formed in the middle portion for engaging with the notches 300, 310 of the housings 30, 31 such that the couplers 2 may be solidly secured to the housings 30, 31 and will not be rotated relative to the housings 30, 31. The couplers 2 each includes an extension 22 extended upward therefrom and each includes a bore 23 formed therein. The bores 23 of the couplers 2 each includes a bottom portion having an orifice 230 of enlarged diameter corresponding to that of the extension 22 for engaging with the extension 22 of the other coupler 2 which is engaged on the other speaker housing, such that the speaker housings can be easily secured together by the couplers 2. The couplers 2 each includes at least one projection 24 formed thereon and each includes at least one curved slot 25 formed therein for slidably engaging with the projection 24 of the other coupler 2 such that the couplers 2 are allowed to be rotated relative to each other and such that rotational movement between the couplers 2 are limited by the engagement between the projection 24 and the curved slot 25, best shown in FIG. 4.

It is to be noted that the electric wire or connecting line 40 (FIGS. 3, 5, 6) may be engaged through the bores 23 of the couplers 2 so as to electrically couple the speakers together.

Figure 5:
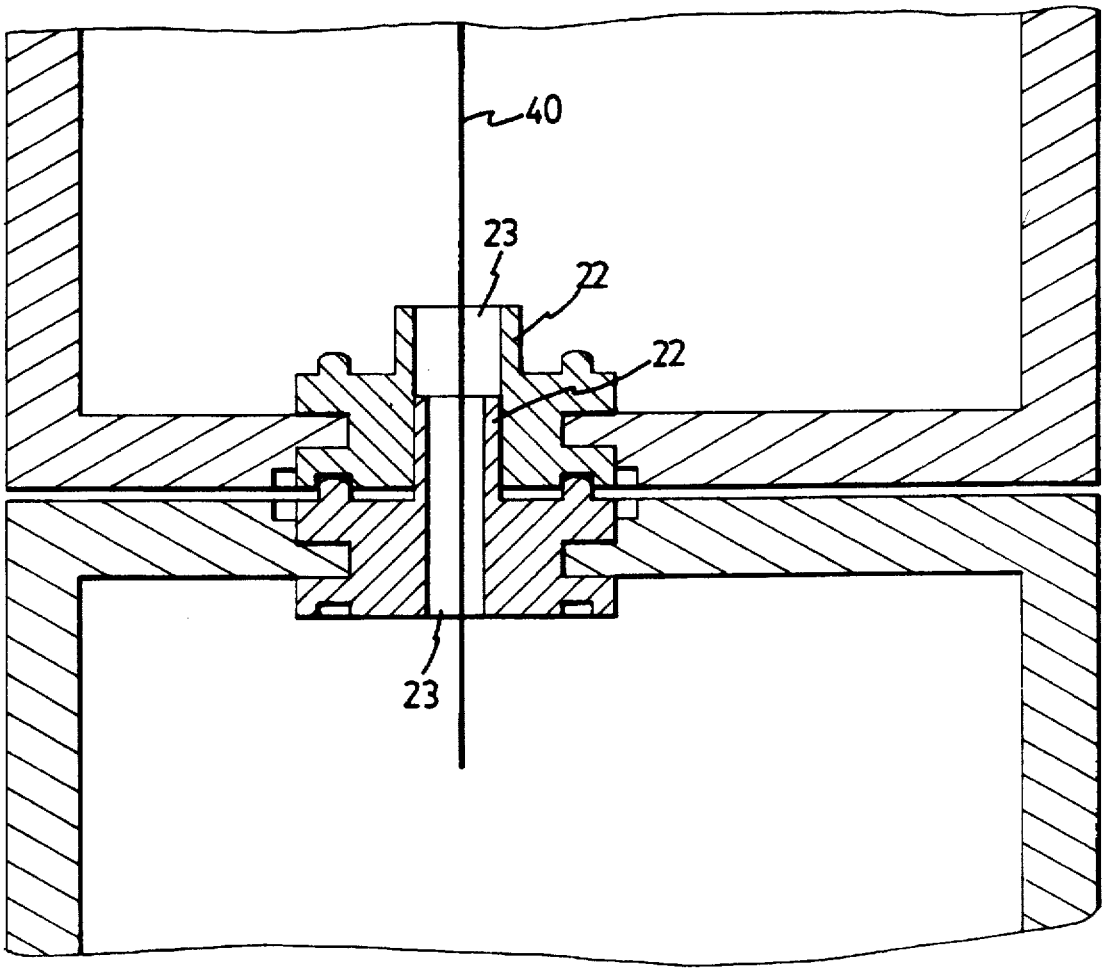
FIGS. 5, 6, 7 are cross sectional views similar to FIG. 3, illustrating three applications of the couplers.
Figure 6:
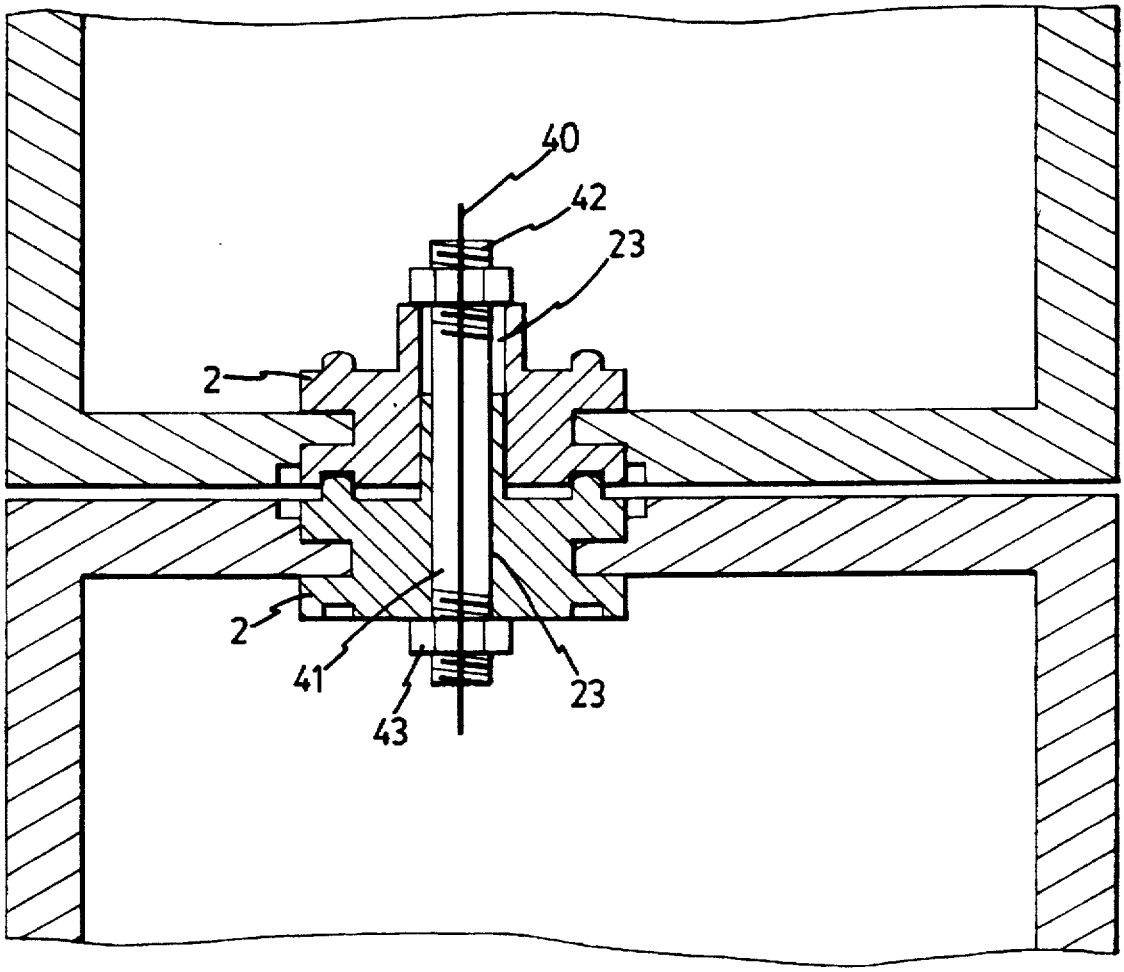
Figure 7:
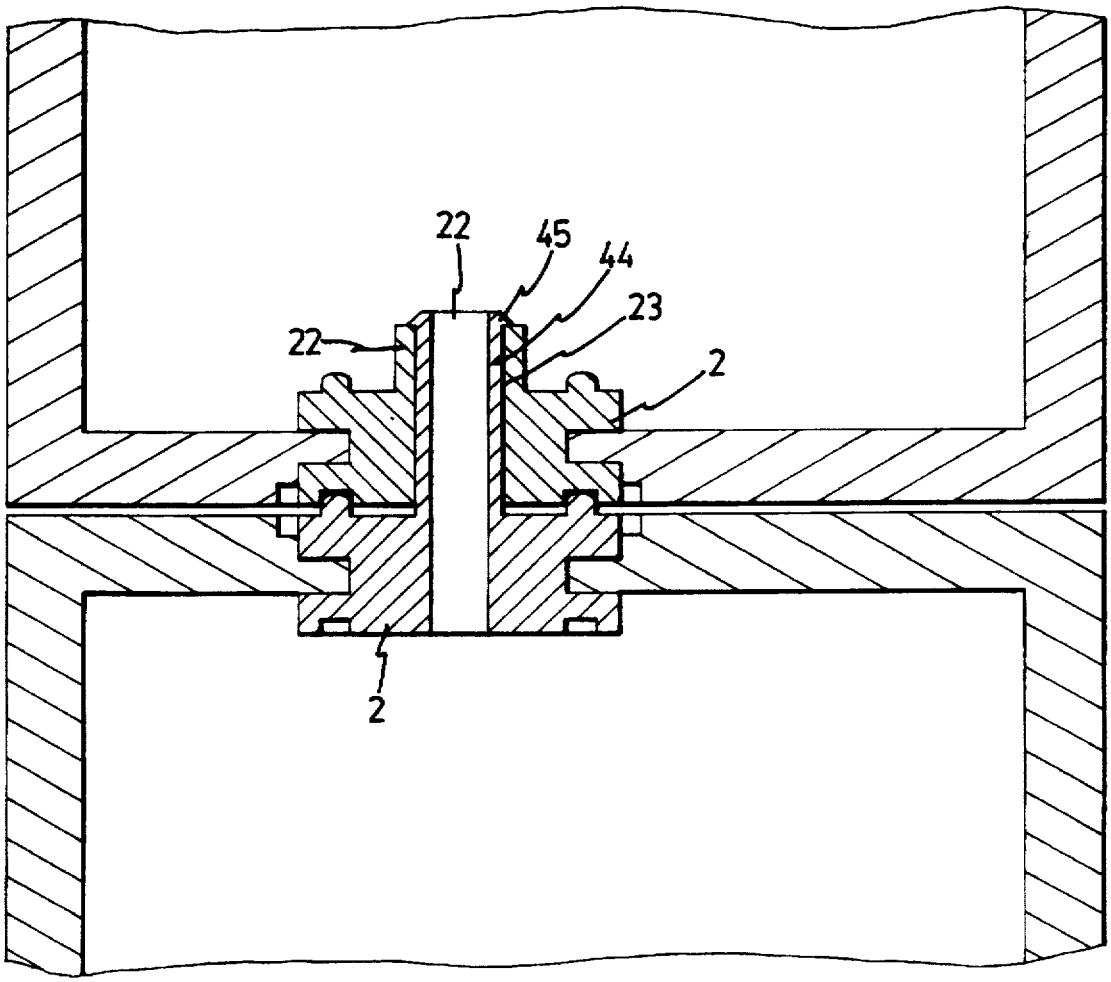

Alternatively, as shown in FIG. 5, the bore 23 of one of the couplers 2 includes a larger size for engaging with the extension 22 of the other coupler 2 which includes a bore 23 of reduced size. As shown in FIG. 6, a bolt 42 may engage through the bores 23 of the couplers 2 and may engage with the nuts 43 so as to further solidly couple the couplers 2 and the speaker housings together. Further alternatively, the extension 22 of one of the couplers 2 may include a number of slits 44 formed therein so as to form a number resilient blades and may include a-hook 45 formed in the free end portion for engaging with the other coupler 2 so as to be secured to the other coupler 2 without fastening screws.

Figure 8:
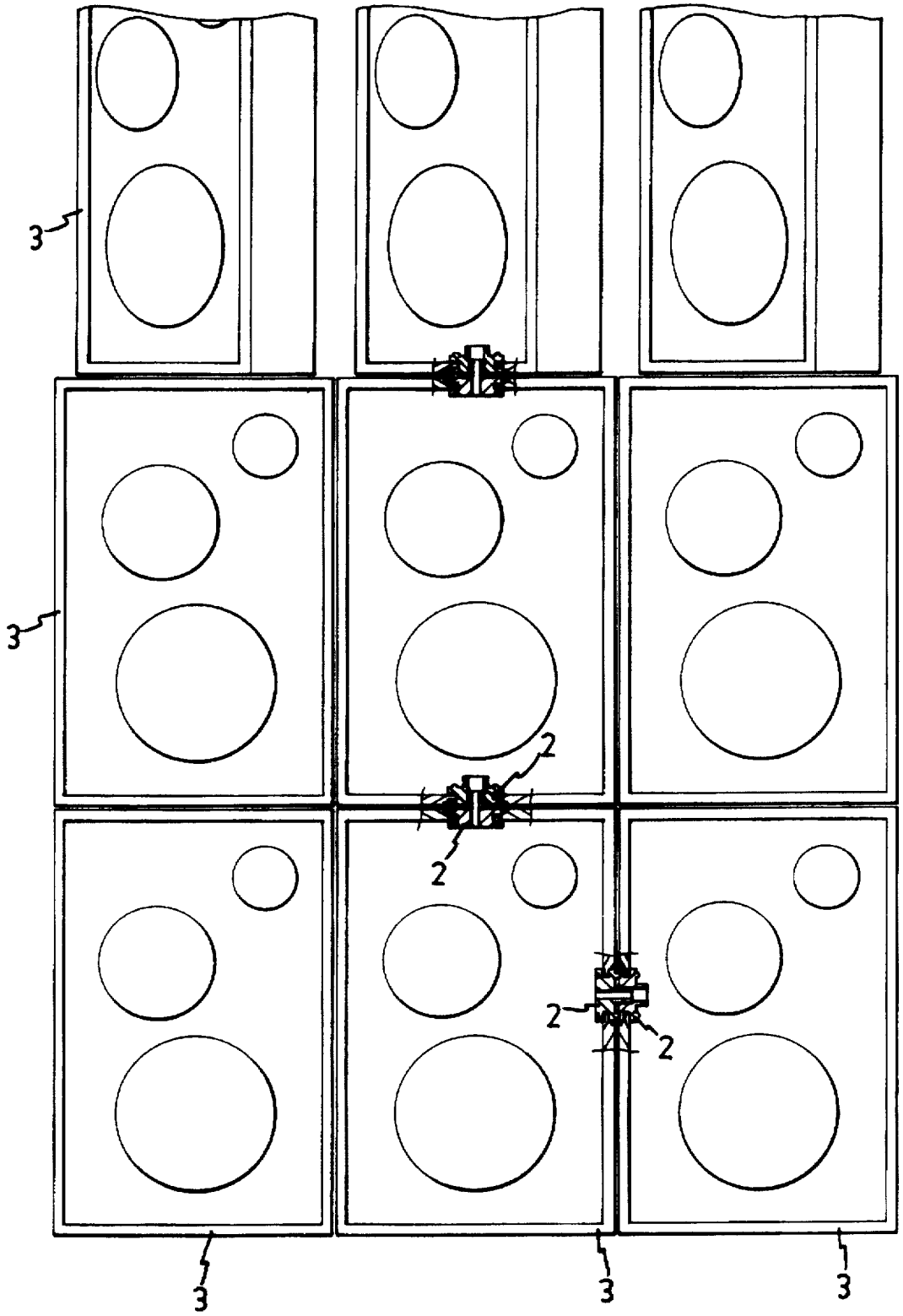
FIGS. 8 and 9 are partial cross sectional views illustrating the coupling of the speakers.
Figure 9:
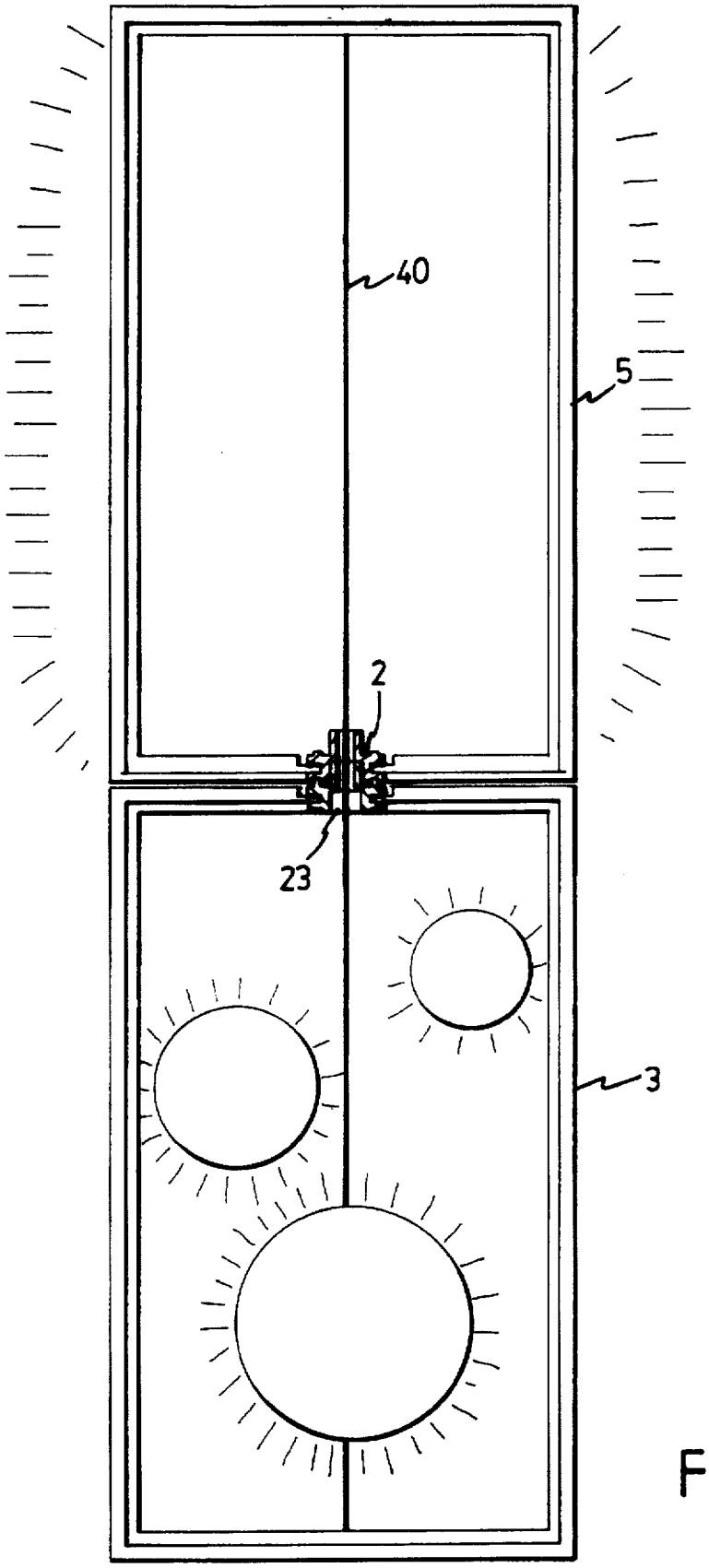

Referring next to FIG. 8, the couplers 2 may also be engaged in the side portions of the speaker housings 3 for coupling the side portions together. It is to be noted that a number of speakers may thus be easily secured together so as to form a speaker wall and so as to replace the typical huge speakers. Referring next to FIG. 9, a casing 5 may also be secured to the speaker housing 3 by the couplers 2. A connecting line 40 may include one end secured to the top of the casing 5 and include a lower portion secured to the speaker housing 3 so as to form two resonance boxes for facilitating the resonance effect thereof.

Accordingly, the speaker assembly in accordance with the present invention includes a coupling mechanism for allowing the speakers to be easily secured together with each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A speaker assembly to comprising:

at least one first housing and at least one second housing, at least one first coupler secured to said first housing and including a bore formed therein, and at least one second coupler secured to said second housing and including an extension extended therefrom for engaging with said bore of said first coupler so as to secure said second coupler to said first coupler and so as to secure said second housing to said first housing, said first coupler including at least one curved slot formed therein, said second coupler including at least one projection formed thereon for slidably engaging with said curved slot so as to limit a rotational movement between said first and said second couplers.

2. A speaker assembly comprising:

at least one first housing and at least one second housing, at least one first coupler secured to said first housing and including a bore formed therein, and at least one second coupler secured to said second housing and including an extension extended therefrom for engaging with said bore of said first coupler so as to secure said second coupler to said first coupler and so as to secure said second housing to said first housing, said first and said second housing each including a pair of notches of different size so as to form a shoulder therebetween, said first and said second couplers each including a middle portion having a peripheral groove formed therein so as to define two plates for engaging with said notches.

3. A speaker assembly according to claim 2, wherein said middle portions of said first and said second couplers each includes a board having a square cross section for engaging with said notches.

4. A speaker assembly comprising:

at least one first housing and at least one second housing, at least one first coupler secured to said first housing and including a bore formed therein, and at least one second coupler secured to said second housing and including an extension extended therefrom for engaging with said bore of said first coupler so as to secure said second coupler to said first coupler and so as to secure said second housing to said first housing, said bore of said first coupler including a first end having an orifice of larger diameter formed therein for engaging with said extension of said second coupler.

5. A speaker assembly comprising:

at least one first housing and at least one second housing, at least one first coupler secured to said first housing and including a bore formed therein, at least one second coupler secured to said second housing and including an extension extended therefrom for engaging with said bore of said first coupler so as to secure said second coupler to said first coupler and so as to secure said second housing to said first housing, said second coupler including a bore formed therein for receiving a wire, and a bolt engaged through said bores of said first and said second couplers, and two nuts for engaging with said bolt so as to secure said first and said second couplers together.

6. A speaker assembly comprising:

at least one first housing and at least one second housing, at least one first coupler secured to said first housing and including a bore formed therein, and at least one second coupler secured to said second housing and including an extension extended therefrom for engaging with said bore of said first coupler so as to secure said second coupler to said first coupler and so as to secure said second housing to said first housing, said extension of said second coupler including at least one slit formed therein so as to define at least two resilient blades and including a free end portion having a hook formed thereon for engaging with said first coupler so as to secure said second coupler to said first coupler.

* * * * *